US008654024B2

(12) United States Patent
Chou

(10) Patent No.: US 8,654,024 B2
(45) Date of Patent: Feb. 18, 2014

(54) ANTENNA MODULE

(75) Inventor: Ming-Yu Chou, New Taipei (TW)

(73) Assignee: Chi Mei Communications Systems, Inc., New Taipei (TW)

( * ) Notice: Subject to any disclaimer, the term of this patent is extended or adjusted under 35 U.S.C. 154(b) by 283 days.

(21) Appl. No.: 13/052,206

(22) Filed: Mar. 21, 2011

(65) Prior Publication Data

US 2012/0127048 A1 May 24, 2012

(30) Foreign Application Priority Data

Nov. 23, 2010 (TW) ..... 99140269

(51) Int. Cl.
*H01Q 9/00* (2006.01)

(52) U.S. Cl.
USPC ..... 343/749; 343/702; 343/700 MS; 343/846

(58) Field of Classification Search
USPC ..... 343/702, 700, 846
See application file for complete search history.

(56) References Cited

U.S. PATENT DOCUMENTS

| | | | | |
|---|---|---|---|---|
| 7,791,546 | B2 * | 9/2010 | Hotta et al. | 343/702 |
| 2003/0174092 | A1 * | 9/2003 | Sullivan et al. | 343/702 |
| 2009/0201209 | A1 * | 8/2009 | Boyle | 343/702 |
| 2010/0141536 | A1 * | 6/2010 | Zhang et al. | 343/702 |

* cited by examiner

*Primary Examiner* — Daniel Hess
*Assistant Examiner* — Steven J Malone
(74) *Attorney, Agent, or Firm* — Altis Law Group, Inc.

(57) ABSTRACT

An antenna includes a first antenna portion, a second antenna portion, a third antenna portion, a feed portion, and a ground portion. The first antenna portion perpendicularly connects to the feed portion and the ground portion. The second antenna portion connects to the first antenna portion. The third antenna portion connects to the feed portion. The first antenna portion and the second antenna portion are both located on a plane perpendicular to the feed portion. The feed portion, the ground portion, and the third antenna portion are coplanar.

4 Claims, 3 Drawing Sheets

ANTENNA MODULE

BACKGROUND

1. Technical Field

The present disclosure relates to an antenna module used in a portable device.

2. Description of Related Art

Portable devices such as mobile phones, personal digital assistants, and laptop computers are widely used. Antennas are installed in such portable devices to receive/send wireless signals. Many devices may operate at different frequencies (e.g., DCS1800, PCS1900, UMTS2100), requiring that the antennas be multiband antennas.

However, many multiband antennas include switch circuits used to switch resonant frequencies of these antennas. The switches can add to the cost of the antennas.

Therefore, there is room for improvement within the art.

BRIEF DESCRIPTION OF THE DRAWINGS

Many aspects of the present disclosure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding portions throughout the figures.

DETAILED DESCRIPTION

Figure 1:
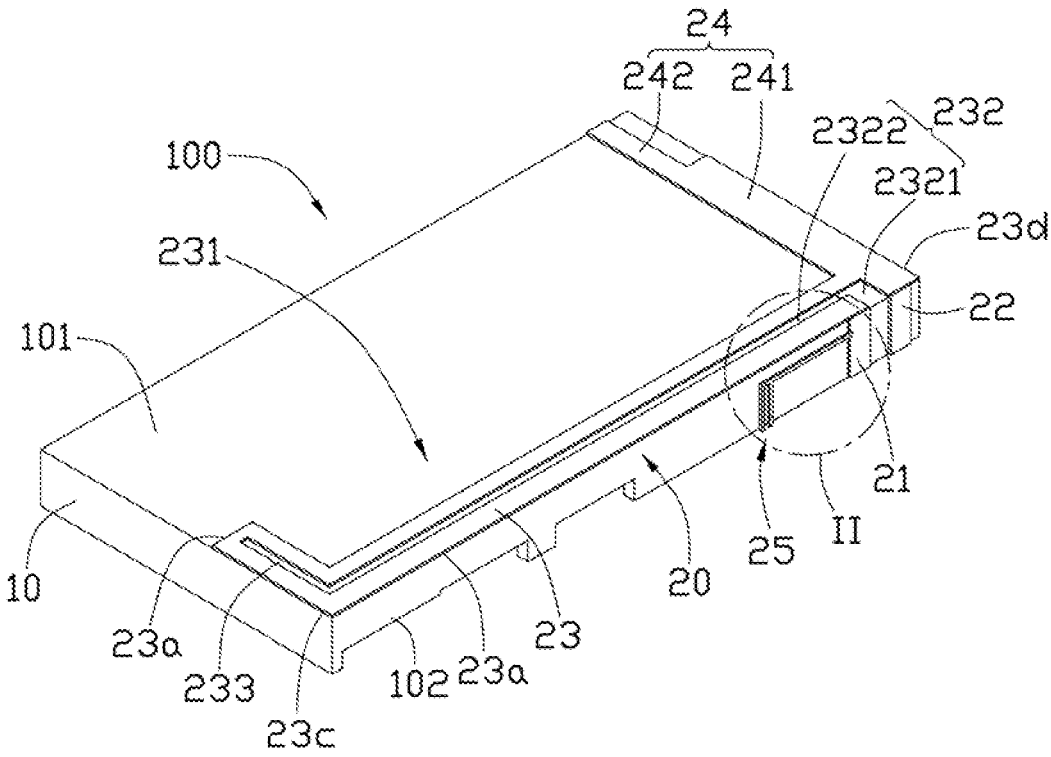
FIG. 1 is a perspective view of an exemplary embodiment of an antenna module.

FIG. 1 is a perspective view of an exemplary embodiment of an antenna module 100. The antenna module 100 is installed in a portable device (not shown) to receive/send wireless signals. The portable device may be a mobile phone, a personal digital assistant, or a laptop computer, for example. In the embodiment, the portable device is a mobile phone. The antenna module 100 includes a support 10 and an antenna 20. The support 10 can be a portion of a housing of the portable device.

The antenna 20 includes a feed portion 21, a ground portion 22, a first antenna portion 23, a second antenna portion 24, and a third antenna portion 25. The feed portion 21, the ground portion 22, and the third antenna portion 25 are disposed on a perimeter surface 102 of the support 10. The first antenna portion 23 and the second antenna portion 24 are disposed on a top surface 101 of the support 10. The feed portion 21 and the ground portion 22 both perpendicularly connect to the first antenna portion 23. The second antenna portion 24 connects to the first antenna portion 23. The third antenna portion 25 connects to the feed portion 21.

The feed portion 21 is rectangular and electrically connects to a signal transmissive end of a printed circuit board (not shown) of the portable device to feed the radio frequency signals. The ground portion 22 is rectangular and parallel to the feed portion 21.

The first antenna portion 23 includes two parallel long edges 23*a*, 23*b*, and two parallel short edges 23*c*, 23*d*. The two short edges 23*c*, 23*d* are perpendicular to the two long edges 23*a*, 23*b*. The first antenna portion 23 is a loop antenna defining an open area 231, a first groove 232, and a second groove 233. The first antenna portion 23 can operate at a high frequency and a low frequency when operative.

The open area 231 is located adjacent the long edge 23*a*. The first groove 232 includes a first gap 2321 and a second gap 2322. The first gap 2321 is located at one end of the long edge 23*b* near the short edge 23*d*. The first gap 2321 is between the feed portion 21 and the ground portion 22, and extends along a direction parallel to the feed portion 21 and the ground portion 22. The second gap 2322 connects to the first gap 2321 and is perpendicular to the first gap 2321. The second groove 233 connects to the second gap 2322 and is perpendicular to the second gap 2322.

The second antenna portion 24 and the first antenna portion 23 are both located on a plane perpendicular to the feed portion 21. The second antenna portion 24 can operate at another high frequency when the antenna 20 is operative, increasing the high frequency range of the antenna 20. The second antenna portion 24 includes a connection section 241 and an extension section 242. The connection section 241 connects to one end of the long edge 23*a* near the short edge 23*d*. The extension section 242 is narrower than the connection section 241. The extension section 242 connects to the connection section 241. One side of the extension section 242 is aligned with one side of the connection section 241.

Figure 2:
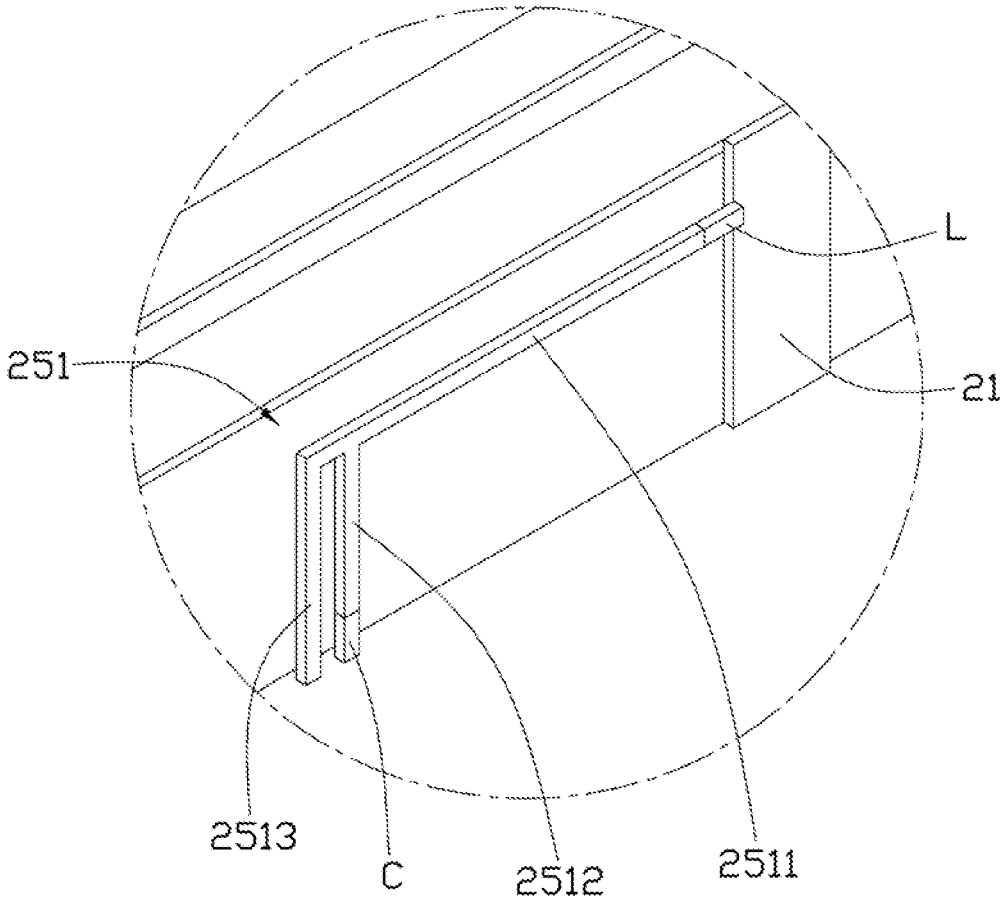
FIG. 2 is an enlarged view of circled portion II shown in FIG. 1.

FIG. 2 is an enlarged view of circled portion II shown in FIG. 1. The third antenna portion 25, the feed portion 21, and the ground portion 22 are coplanar. The third antenna portion 25 can operate at another low frequency when the antenna 20 is operative, increasing the low frequency range of the antenna 20. The third antenna portion 25 includes a main body 251, a capacitor C, and an inductor L. In the exemplary embodiment, the main body 251 is a planar inverted-F antenna (PIFA) and includes a first radiating section 2511, a second radiating section 2512, and a third radiating section 2513.

The main body 251 connects to the feed portion 21 through the inductor L, and connects to ground through the capacitor C. The first radiating section 2511 connects to the feed portion 21 through the inductor L. The second radiating section 2512 perpendicularly connects to one end of the first radiating section 2511 away from the feed portion 21. The third radiating section 2513 is shorter than the second radiating section 2512. The third radiating section 2513 is disposed between the second radiating section 2512 and the feed portion 21. One end of the third radiating section 2513 perpendicularly connects to the first radiating section 2511, and the other end of the third radiating section 2513 connects to ground through the capacitor C.

Figure 3:
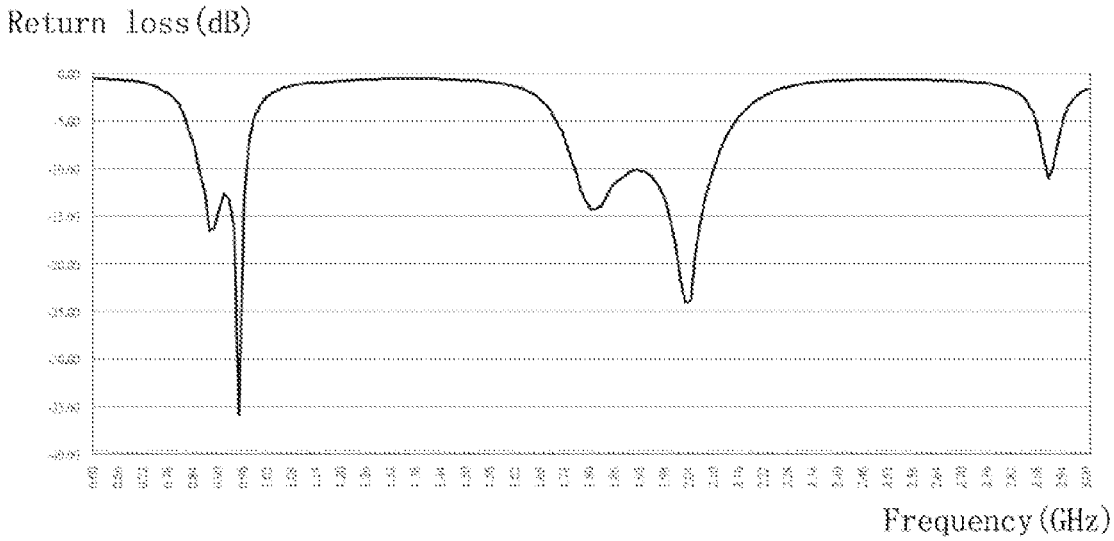
FIG. 3 is a return loss diagram of the antenna module of FIG. 1.

FIG. 3 is a return loss diagram of the antenna module 100 of FIG. 1. Referring to FIG. 3, the antenna module 100 may be operative at different communication standards, GSM850, EGSM900, DCS1800, PCS1900, WCDMA I, WCDMA II, WCDMA IV, WCDMA V, and WCDMA VIII. Referring to Table 1, requirements for desired efficiency of the antenna module 100 are satisfied.

TABLE 1

Average efficiency of antenna module 100

| | Efficiency | |
|---|---|---|
| Standard | Tx | Rx |
| GSM850 | −3.79 | −1.89 |
| EDGE900 | −2.21 | −4.61 |
| DCS1800 | −3.62 | −2.96 |
| PCS1900 | −3.08 | −2.91 |

TABLE 1-continued

| Average efficiency of antenna module 100 | | |
|---|---|---|
| | Efficiency | |
| Standard | Tx | Rx |
| WCDMA I | −2.88 | −3.69 |
| WCDMA II | −3.08 | −2.91 |
| WCDMA IV | −3.62 | −2.96 |
| WCDMA V | −3.79 | −1.89 |
| WCDMA VIII | −2.21 | −4.61 |

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of portions within the principles of the present invention to the full extent indicated by the broad general meaning of the terms in which the appended claims are expressed.

What is claimed is:

1. An antenna, comprising:

a feed portion;

a ground portion;

a first antenna portion perpendicularly connecting to the feed portion and the ground portion;

a second antenna portion connecting to the first antenna portion; and a third antenna portion connecting to the feed portion;

wherein the first antenna portion and the second antenna portion are both located on a plane perpendicular to the feed portion;

wherein the feed portion, the ground portion, and the third antenna portion are coplanar; and the first antenna portion is a loop antenna and defines a first groove and a second groove; the first groove includes a first gap and a second gap, the first gap is between the feed portion and the ground portion and extends along a direction parallel to the feed portion and the ground portion, the second gap communicates with and is perpendicular to the first gap, the second groove communicates with and is perpendicular to the second gap;

the third antenna portion comprises a main body, a capacitor, and an inductor; wherein the main body connects to the feed portion through the inductor, and connects to ground through the capacitor;

the main body is a planar inverted-F antenna (PIFA);

the third antenna portion further comprises:

a first radiating section connecting to the feed portion through the inductor;

a second radiating section perpendicularly connecting to one end of the first radiating section away from the feed portion; and a third radiating section disposed between the second radiating section and the feed portion;

one end of the third radiating section perpendicularly connects to the first radiating section, and the other end of the third radiating section connects to ground through the capacitor.

2. The antenna of claim 1, wherein the feed portion and the ground portion are parallel.

3. The antenna of claim 1, wherein the first antenna portion comprises:

two parallel long edges; and two short edges perpendicular to the two long edges.

4. The antenna of claim 3, wherein the second antenna portion comprises:

a connection section connecting to one of the two long edges near one of the two short edges; and an extension section connecting to the connection section.

* * * * *